US007983610B2

(12) United States Patent
Hamahashi

(10) Patent No.: US 7,983,610 B2
(45) Date of Patent: Jul. 19, 2011

(54) IMAGE FORMATION METHOD AND AN IMAGE FORMATION APPARATUS

(75) Inventor: Shunsuke Hamahashi, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 554 days.

(21) Appl. No.: 11/713,506

(22) Filed: Mar. 2, 2007

(65) Prior Publication Data

US 2007/0212141 A1 Sep. 13, 2007

(30) Foreign Application Priority Data

Mar. 2, 2006 (JP) ..... 2006-056748

(51) Int. Cl.
*G03G 15/00* (2006.01)

(52) U.S. Cl. ..... 399/401; 399/389

(58) Field of Classification Search ..... 399/401, 399/389

See application file for complete search history.

(56) References Cited

U.S. PATENT DOCUMENTS

| | | | | | |
|---|---|---|---|---|---|
| 4,693,586 | A * | 9/1987 | Sumida et al. | 399/401 |
| 4,978,980 | A * | 12/1990 | Noguchi et al. | 347/111 |
| 5,132,742 | A * | 7/1992 | Goto | 399/401 |
| 5,703,693 | A * | 12/1997 | Morikawa | 358/296 |
| 6,041,213 | A * | 3/2000 | Yanagi | 399/401 |
| 7,570,897 | B2 * | 8/2009 | Nihei | 399/82 |
| 2003/0107765 | A1 * | 6/2003 | Suzuki et al. | 358/1.18 |
| 2004/0120744 | A1 * | 6/2004 | Fukada et al. | 399/401 |

FOREIGN PATENT DOCUMENTS

| | | |
|---|---|---|
| JP | 3233469 | 10/1991 |
| JP | 2001-322317 | 11/2001 |
| JP | 2001-326786 | 11/2001 |
| JP | 2001326785 | * 11/2001 |
| JP | 2004347627 | * 9/2004 |

* cited by examiner

*Primary Examiner* — Anthony H. Nguyen
(74) *Attorney, Agent, or Firm* — Cooper & Dunham LLP

(57) ABSTRACT

An image formation apparatus configured to switch between an inter-leaf operation and a non-inter-leaf operation is provided for double-sided printing.

12 Claims, 6 Drawing Sheets

IMAGE FORMATION METHOD AND AN IMAGE FORMATION APPARATUS

BACKGROUND OF THE INVENTION

1. Technical Field

This disclosure relates to a double-side image formation method applicable to image formation apparatuses such as a laser beam printer (page printer), a copying machine, a facsimile apparatus, and a multifunction machine; and an image formation apparatus for realizing the method.

2. Description of the Related Art

[Background Technique]

As a double-side image formation method of the image formation apparatuses (such as a laser beam printer and a copying machine) that include a reversing unit and an image formation unit along a conveyance way of a recording medium such as paper, the image formation unit forms an image on one side of a recording medium that is fed from a feed unit, the reversing unit returns the recording medium to the image formation unit, and an image is formed on the other side of the recording medium. More specifically, for example, when 30 sheets of the recording medium (paper), i.e., 60 pages, are to be copied, 30 pages are first copied on one side of the sheets, and the 30 sheets are stacked on a middle tray through the reversing unit. Then, the stacked recording media are provided to the image formation unit one by one, and the other 30 pages are copied onto their other side (for example, Patent Reference 1). This double-side image formation method is called a stack mode method.

Another double-side image formation method is called an inter-leaf method that is intended to raise productivity of double-side image formation. When a manuscript that includes two or more sheets, where each sheet bears an image to be copied only on one side, is to be copied to both sides of the recording media for two or more copies, the inter-leaf method realizes 100% double-side image formation productivity by removing losses not only in a last phase but also in early stages. In other words, the time required for one-side image formation is the same as time required for double-side image formation. In order to realize high productivity, Patent Reference 2 proposes a double-side image formation apparatus wherein the number of inter-leaf sheets, only one side of which sheets is continuously recorded (printed) at the time of recording start, is n, the apparatus is capable of storing at least (2n−1) sheets of the recording medium in a double-side conveyance path, through which path the recording media are conveyed when double-side recording is performed, wherein in the early stages until inter-leaf control is started, copying onto only one side of x sheets of the recording medium is continuously performed, where $n<x<=2n-1$, then, copying onto the other side of y sheets of the recording medium is continuously performed, where $y=x-n+1$, and then, the inter-leaf control for n sheets is performed.

Further, Patent Reference 3 discloses a technique of the inter-leaf control for further raising the double-side image formation productivity by reducing losses in a final paper process. There, recording information that sequentially continues for every page is stored, and recording information for two pages is recorded on each side of a recording medium out of all the stored recording information. According to the technique, the inter-leaf control is performed for alternately printing (copying) onto a recording medium, one side of which recording medium has been printed, and a new recording medium. There, if the number of sheets of the recording medium, the first page of which recording medium is continuously printed in the beginning is n, the number of sheets of the recording medium, the first page of which recording medium is continuously printed in the last phase is n+1.

[Patent Reference 1] JP 3002216

[Patent Reference 2] JPA 2001-326786

[Patent Reference 3] JPA 2001-322317

An inter-leaf operation is for preventing the productivity of double-side printing from being degraded as described above. Properties of the inter-leaf operation are dependent on sheet length, conveyance path length, and productivity (space/interval between sheets). The inter-leaf operations disclosed by Patent References 2 and 3 take the number of inter-leaf sheets into consideration; however, the sheet length, the conveyance path length, and the productivity are not considered.

SUMMARY

In an aspect of this disclosure, there are provided an image formation method and an image formation apparatus that prevent the productivity of double side printing from degrading due to shortening of the double side conveyance path accompanying miniaturization of the image formation apparatus. In another aspect of this disclosure, there is provided an image formation method for both side printing, wherein an inter-leaf operation and a non-inter-leaf operation are switched based on information about sheet length (sheet length information).

According to another aspect, the sheet length information is acquired based on at least one of a detection result of a sheet length detection sensor formed in a sheet loading unit, image size information, and a detection output of a resist sensor.

According to another aspect, the inter-leaf operation is carried out if the inter-leaf operation is determined to be possible for two or more consecutive sheets based on the size of the sheets, wherein the determination is based on the sheet length information acquired as described above.

According to another aspect, the inter-leaf operation is carried out for a number of sheets, where the number is three or greater, if the inter-leaf operation is determined to be possible for the number of sheets, wherein the determination is based on the sheet length information acquired as described above.

According to another aspect, the sheet length information is acquired based on a detection output of a resist sensor, and for this purpose, double-side printing is carried out by the non-inter-leaf operation only for the first sheet. Then, whether the inter-leaf operation is possible is determined based on the acquired sheet length information; and if affirmative, the inter-leaf operation is carried out.

In another aspect of this disclosure, there is provided an image formation apparatus that includes:

a sheet length detection unit for detecting the length of a sheet, am image formation unit for forming an image on the sheet, a fixing unit for fixing the image formed on the sheet, a sheet reversing unit for reversing the sheet, a double-sided conveyance path wherein the reversed sheet passes, and a control unit for controlling switching between the inter-leaf and non-inter-leaf operations based on the sheet length.

According to another aspect of the embodiment, the image formation apparatus includes a sheet loading unit that includes a sheet size detection sensor for acquiring the sheet length.

According to another aspect of the embodiment, the image formation apparatus includes an automatic manuscript reader that is capable of acquiring the image size to be formed on the sheet, wherein the sheet of a size (sheet length and sheet width) that suits the image size is fed, and switching between the inter-leaf and non-inter-leaf operations is carried out based on the sheet length.

According to another aspect of the embodiment, the image formation apparatus includes a controller, wherein the image size formed on the sheet is provided by an input to the controller, the sheet of a size that suits the image size is fed, and switching between the inter-leaf and non-inter-leaf operations is carried out based on the sheet length.

According to another aspect of the embodiment, the image formation apparatus includes a resist sensor, wherein the sheet length information is acquired based on a result of the resist sensor detecting the sheet during transportation.

According to another aspect of the embodiment of the image formation apparatus, the sheet length is acquired by performing double-side printing by the non-inter-leaf operation only on the first sheet. Then if the inter-leaf operation is possible for the acquired sheet length, the inter-leaf operation is carried out.

According to another aspect of the embodiment of the image formation apparatus, the control unit performs the inter-leaf operation if it is determined that the inter-leaf operation is possible for two or more consecutive sheets. The determination is based on the sheet length that is acquired.

According to another aspect of the embodiment of the image formation apparatus, the control unit performs the inter-leaf operation for a number of sheets, which number is three or greater, if it is determined that the inter-leaf operation of the number of sheets is possible, wherein the determination is based on the acquired sheet length.

In addition, in the following description of the embodiment of the present invention, the detection output of the sheet length detection sensor corresponds to a sheet length sensor signal 108, a resist sensor is referenced to by 20, the detection output of the resist sensor corresponds to a resist sensor signal 105, the image size information corresponds to size information provided by one of an ADF 114 and a controller 100, and the control unit corresponds to a CPU 101.

EFFECTIVENESS OF INVENTION

According to the embodiment of the present invention, the inter-leaf operation and non-inter-leaf operations are switched based on the sheet length information, and in this way, productivity degradation of double-side printing due to a shortened double-side conveyance path accompanying the miniaturization of the image formation apparatus can be prevented.

DESCRIPTION OF THE PREFERRED EMBODIMENTS

In the following, embodiments of the present invention are described with reference to the accompanying drawings.

Figure 1:
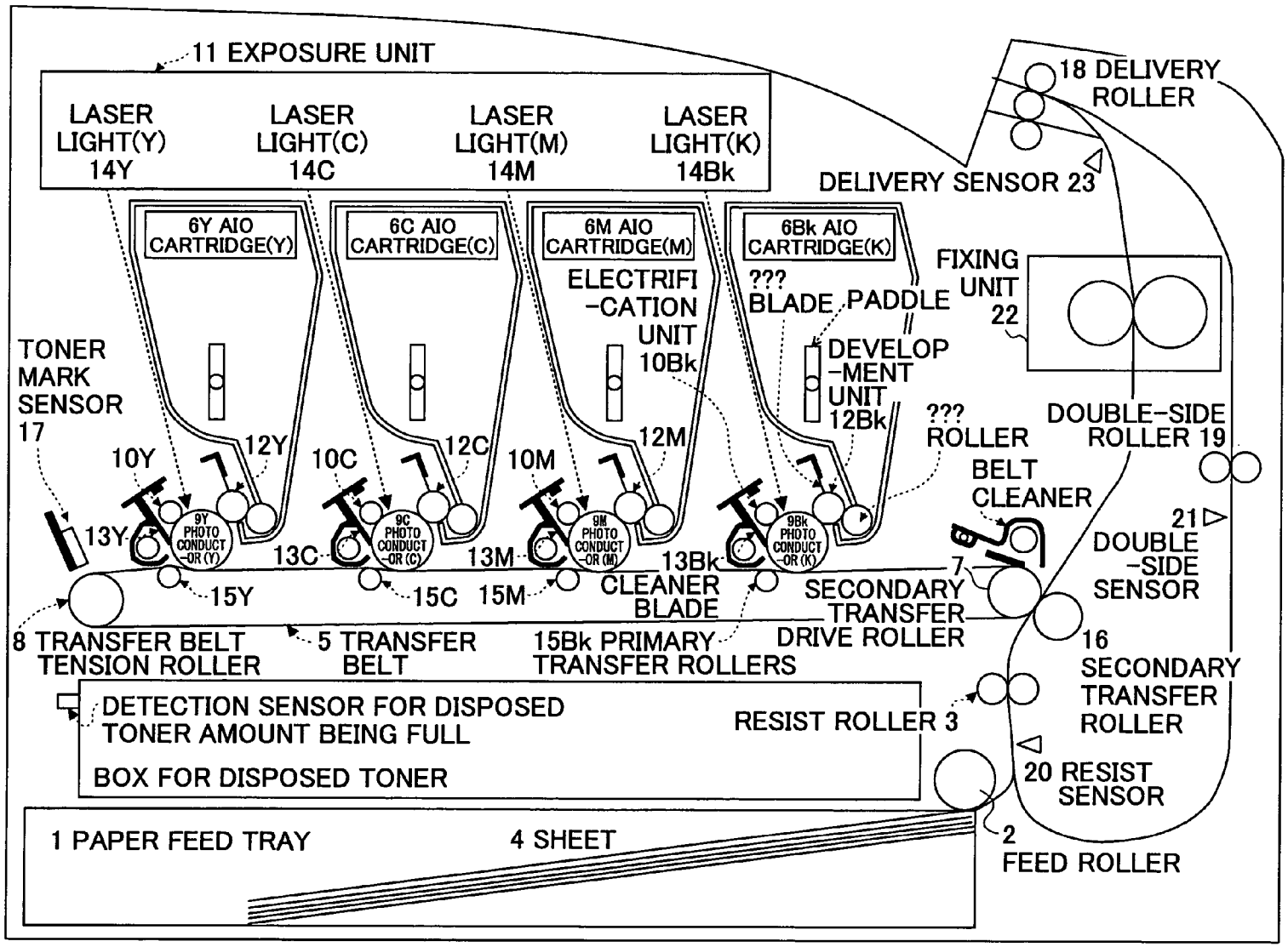
FIG. 1 is a cutaway diagram of an image formation apparatus according to an embodiment of the present invention.

FIG. 1 shows the outline of an image formation apparatus according to the embodiment of the present invention. Here, the image formation apparatus includes AIO cartridges 6Bk, 6M, 6C and 6Y for corresponding colors arranged along a transfer belt 5; and the image formation apparatus is of a so-called tandem type. The transfer belt 5 rotates counter-clockwise in FIG. 1, and two or more AIO cartridges (electronic photography processing units) 6Bk, 6M, 6C and 6Y are arranged in this sequence from the upstream of the rotation of the transfer belt 5. The AIO cartridges 6Bk, 6M, 6C and 6Y are configured the same, except that the color of toner contained is different for each one. The AIO 6Bk is for forming an image in black, the AIO cartridge 6C is for forming an image in cyan, the AIO cartridge 6Y is for yellow, and the AIO cartridge 6M is for magenta.

In the following, the AIO cartridge 6Bk is taken as representative of the AIO cartridges, and described in detail. Other AIO cartridges, namely, 6M, 6C, and 6Y are configured the same as the AIO cartridge 6Bk. Accordingly, members that configure the image formation units (AIO cartridges) 6M, 6C, and 6Y are called by names corresponding to the members that configure the AIO cartridge 6Bk with Bk being replaced by M, C, and Y, as applicable.

The transfer belt 5 is an endless belt, and wound around a secondary transfer drive roller 7 and a transfer belt tension roller 8. The secondary transfer drive roller 7 is rotationally driven by a non-illustrated drive motor. The drive motor, the secondary transfer drive roller 7, and the transfer belt tension roller 8 function as a drive unit for moving the transfer belt 5. The image formation unit 6Bk includes a photo conductor 9Bk, an electrification unit 10Bk arranged around the photo conductor 9Bk, an exposure unit 11, a development unit 12Bk, and a cleaner blade 13Bk. The exposure unit 11 is for emitting laser lights 14Bk, 14M, 14C and 14Y for color images formed by the AIO cartridges 6Bk, 6M, 6C, and 6Y, respectively. Further, a toner mark sensor 17 is arranged on the downstream side of the transfer belt 15.

When an image is to be formed, the surface of the photo conductor 9Bk is uniformly charged by the electrification unit 10Bk, the laser light 14Bk for the black image is emitted from the exposure unit 11, and a static latent image is formed. The development unit 12Bk develops the static latent image with black toner to form a visible image, i.e., a toner image, and the toner image in black is formed on the photo conductor 9Bk. The toner image is transferred onto the transfer belt 5 by a primary transfer roller 15Bk at a location (primary transfer location) where the photo conductor 9Bk and the transfer belt 5 touch. In this way, the toner image in black is formed on the transfer belt 5. Then, the cleaner blade 13Bk wipes away residual toner that remains on the surface of the photo conductor 9Bk that has transferred the toner image, and the photo conductor 9Bk stands by for the next image formation.

As described above, the transfer belt 5 that has received the toner image in black formed by the AIO cartridge 6Bk moves to the following AIO cartridge 6M. The AIO cartridge 6M forms a toner image in magenta on the photo conductor 9M in the same way as the image formation process of the AIO cartridge 6Bk, and the toner image in magenta is superposed onto the toner image in black already formed on the transfer belt 5. The transfer belt 5 further moves to the following AIO cartridges 6C and then 6Y, and a toner image in cyan formed on the photo conductor 9C and a toner image in yellow formed on the photo conductor 9Y are sequentially superposed onto the transfer belt 5. In this way, a full color image is formed on the transfer belt 5. The transfer belt 5 conveys the full color superposed image to the location of the secondary transfer roller 16.

Here, if printing in only black color is required, the primary transfer rollers 15M, 15C, and 15Y are moved to a location separated from the photo conductors 9M, 9C, and 9Y, respectively, when image formation is performed, and only the image formation process for black color is performed.

Details in the case of double-side printing are as follows.

First, printing on one side (the first page) is carried out as follows. One of sheets 4 loaded in a paper feed tray 1 is fed by a feed roller 2. A resist sensor 20 detects the tip of the fed sheet 4, the tip is pushed to a nip of a resist roller 3 so that the sheet is bent, and rotation of the feed roller 2 is stopped. Then, the feed roller 2 and the resist roller 3 start rotation at a timing that agrees with the image arriving at the secondary transfer roller 16, the toner image is transferred onto the sheet, and the toner image is fixed to the sheet by a fixing unit 22. Then, printing on the other side (the second page) of the sheet 4 is carried out as follows. A delivery solenoid (not illustrated) of a delivery roller 18 is switched so that the sheet 4 is switched back, and the sheet is fed through the double-side conveyance path. Subsequently, the sheet is conveyed by a double-side roller 19. The resist sensor 20 detects the tip of the fed sheet 4, and the tip is pushed to the resist roller 3, bending is generated, and the rotation of the double-side roller 19 is stopped. At timing that agrees with the image arriving at the location of the secondary transfer roller 16, the double-side roller 19 and the resist roller 3 are started to rotate, the toner image is transferred onto the second page of the sheet, and the toner image is fixed to the sheet by the fixing unit 22. The sheet 4 that bears fixed images is discharged outside the image formation apparatus, and double-side printing is completed. In addition, the image formation apparatus includes a double-side sensor 21 and a delivery sensor 23.

Double-side printing can be realized by an inter-leaf operation and a non-inter-leaf operation. First, the non-inter-leaf operation is described.

Sequence of the image formation is as follows: first sheet first page->first sheet second page->second sheet first page->second sheet second page->third sheet first page->third sheet second page, and so on. Here, it takes time for the sheet bearing the image on its first page to be switched back by the delivery roller unit 18, to travel through the double-side conveyance path, and to reach the secondary transfer roller 16 again; accordingly, efficiency and productivity are low. On the other hand, according to the inter-leaf operation, the sequence of image formation is as follows: first sheet first page->second sheet first page->first sheet second page->third sheet first page->second sheet second page->fourth sheet first page, and so on. That is, while a sheet travels to the secondary transfer roller 16 after the first page of the sheet is processed, the first page of the following sheet is processed. Then, the second page of the n-th sheet and the first page of the (n+2)-th sheet are alternately processed by turns. In this way, two or more sheets are simultaneously present in the conveyance path, and the productivity is improved.

Above is the basic inter-leaf operation. Where the conveyance path length is great compared with the sheet length, the inter-leaf operation can be arranged such that three or more sheets are simultaneously present in the conveyance path, which inter-leaf operation is hereafter called multi-sheet inter-leaf operation. According to the multi-sheet inter-leaf operation, the sequence of the image formation is as follows: first sheet first page->second sheet first page->third sheet first page->first sheet second page->fourth sheet first page->second sheet second page, and so on.

Whether the inter-leaf operation is possible depends on the sheet length, the conveyance path length, and the productivity. Here, the conveyance path length and the productivity are fixed factors given by layout and specification of the image formation apparatus; however, the sheet length is a variable since the sheet is provided by a user. For this reason, the sheet length has to be acquired by a certain method, and whether the inter-leaf operation is possible has to be determined. That is, whether the inter-leaf operation or the non-inter-leaf operation is to be performed is determined based on the acquired sheet length.

Figure 2:
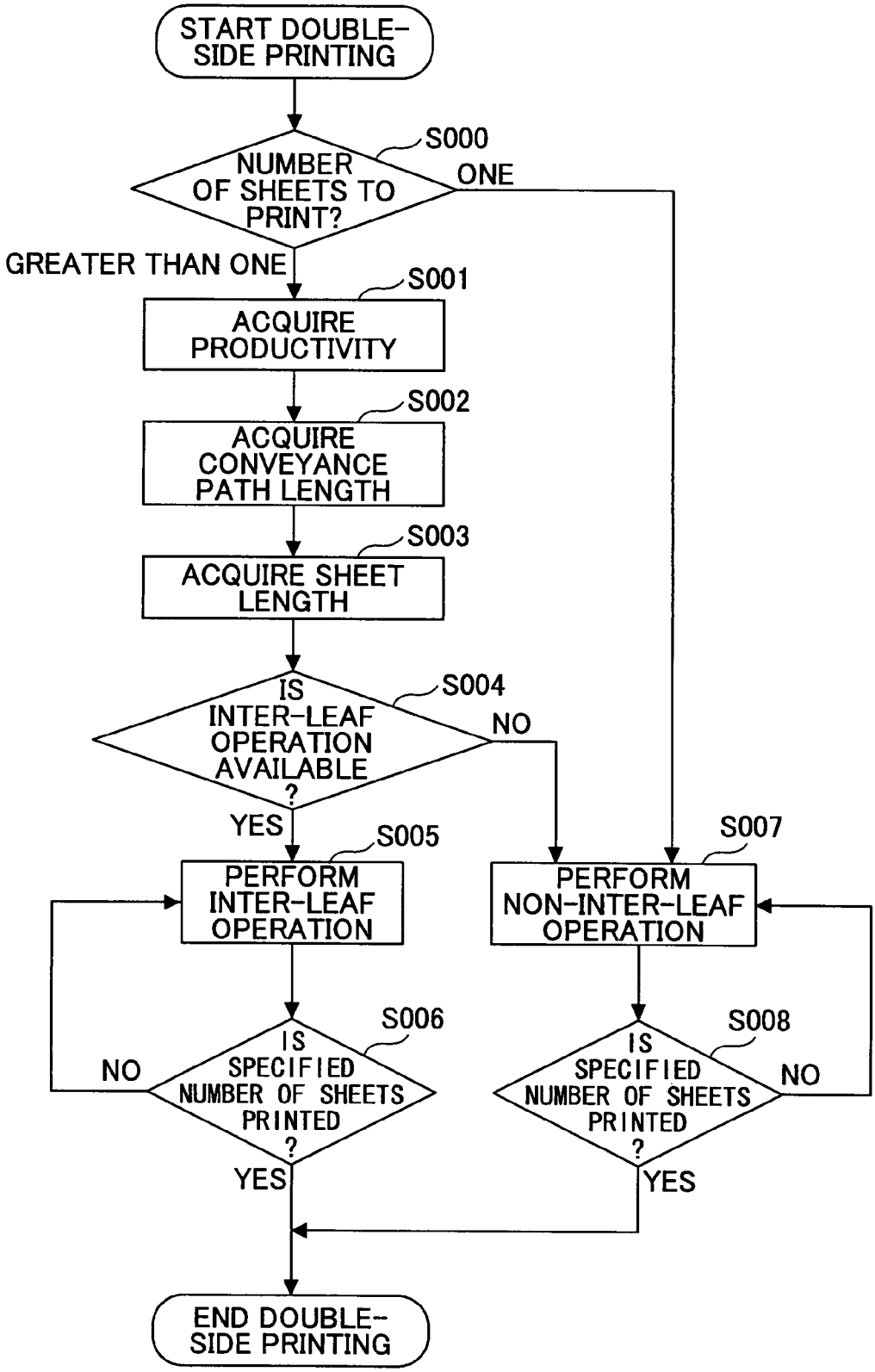
FIG. 2 is a flowchart of a double-side printing control process in the case where a sheet size for printing is fixed, and a sheet length is known at the time of feeding the sheet.

FIG. 2 is a flowchart showing a double-side printing control process wherein the sheet size (sheet length and sheet width) for printing is fixed, and the sheet length is known at the time of feeding start. According to this control process, whether the number of sheets to be printed is one or greater than one is determined at step S000. If only one sheet is to be printed, double-side printing by the non-inter-leaf operation is performed at step S007. If more than one sheet is to be printed, parameters (productivity, conveyance path length, and sheet length) that determine availability of the inter-leaf operation (whether the inter-leaf operation is possible) are acquired at steps S001, S002, and S003, respectively. Then, the availability of the inter-leaf operation is determined at step S004. If affirmative, the inter-leaf operation is performed until the specified number of sheets is printed at steps S005 and S006.

Figure 6:
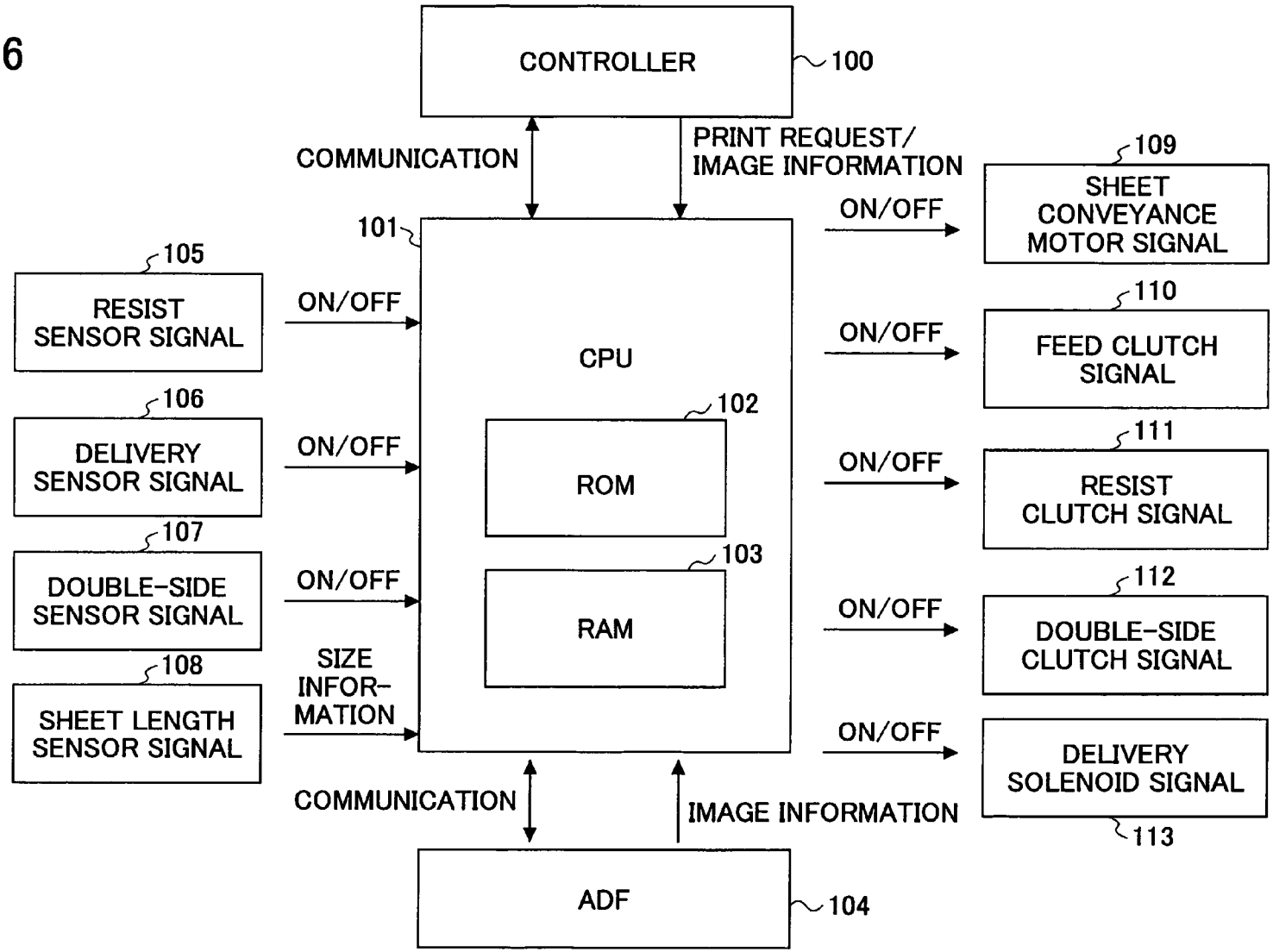
FIG. 6 is a block diagram of a control unit.

Here, the sheet length is made a known factor by various methods before paper feed starts; e.g., the image size may be acquired by inputting size information to a controller 100 of a control unit (ref. FIG. 6). Alternatively, the image size can be acquired by an external apparatus such as an ADF 114. In these cases, a CPU 101 of the controller 100 uses a table wherein each paper feed tray is associated with the sheet size. Alternatively, a sheet length sensor 108 may be provided so that the size of the sheet loaded to the paper feed tray is acquired.

Figure 3:
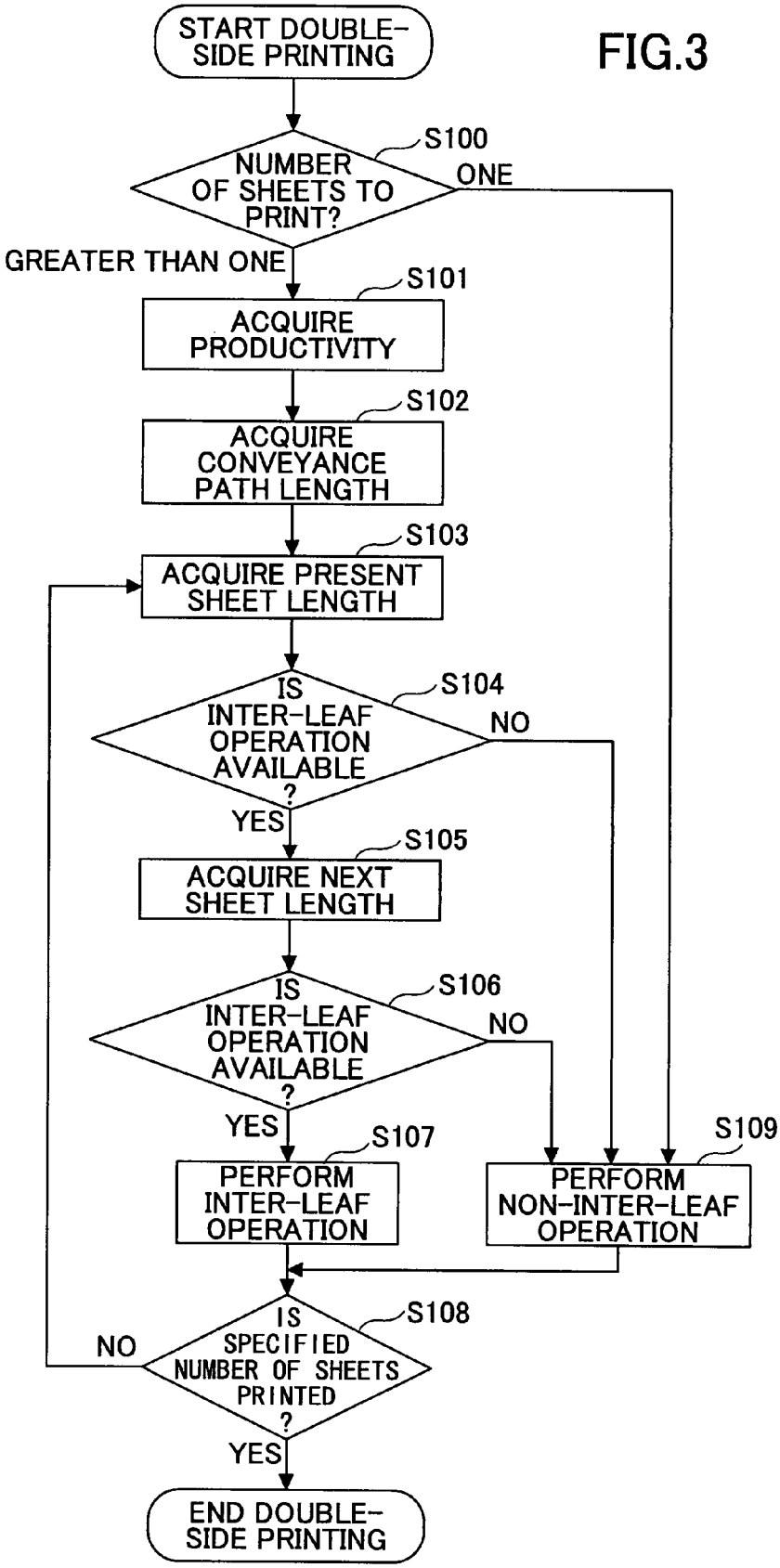
FIG. 3 is a flowchart of the double-side printing control process in the case where different sheet sizes are intermingled.

However, in actual operations, the sheet size is not necessarily fixed, but varies. FIG. 3 is a flowchart showing the double-side printing control process wherein the sheet sizes are intermingled. At step S100, the number of sheets to be printed is determined. If the number is two or greater, the productivity and the conveyance path length are acquired at steps S101 and S102, respectively. Then, the present sheet length is acquired at step S103, and whether an inter-leaf operation is possible is determined at step S104. If affirmative, the next sheet length is acquired at step S105, and whether the inter-leaf operation is possible is determined at step S106. If it is determined that the inter-leaf operation is possible for the two consecutive sheet lengths, the inter-leaf operation is performed at step S107. On the other hand, in one of the cases wherein the number of sheets to be printed is one, the inter-leaf operation is determined to be impossible due to the present sheet length, and the inter-leaf operation is determined to be impossible due to the next sheet length, the process proceeds to step S109 where the non-inter-leaf operation is performed. Then, steps S103 through S107, or steps S103 through S109, as applicable are repeated until the specified number of sheets is processed.

FIG. 6 shows the basic structure of the control unit including:

the CPU 101 that includes a ROM 102 and a RAM 103;

the controller 100 that communicates with the CPU 101 for providing a printing request and image information; and the ADF 104 that communicates with the CPU 101 for providing image information to the CPU 101. Further, the CPU 101 receives signals indicating the size of the sheet, namely, a resist sensor signal 105, a delivery sensor signal 106, a double-side sensor signal 107, and a sheet length sensor signal 108. Further, the CPU 101 outputs signals such as a paper conveyance motor signal 109, a feed clutch signal 110, a resist clutch signal 111, a double-side clutch signal 112, and a delivery solenoid signal 113 for controlling drive of a paper conveyance motor, a delivery clutch, a resist clutch, a double-side clutch, and a delivery solenoid, respectively.

Figure 4:
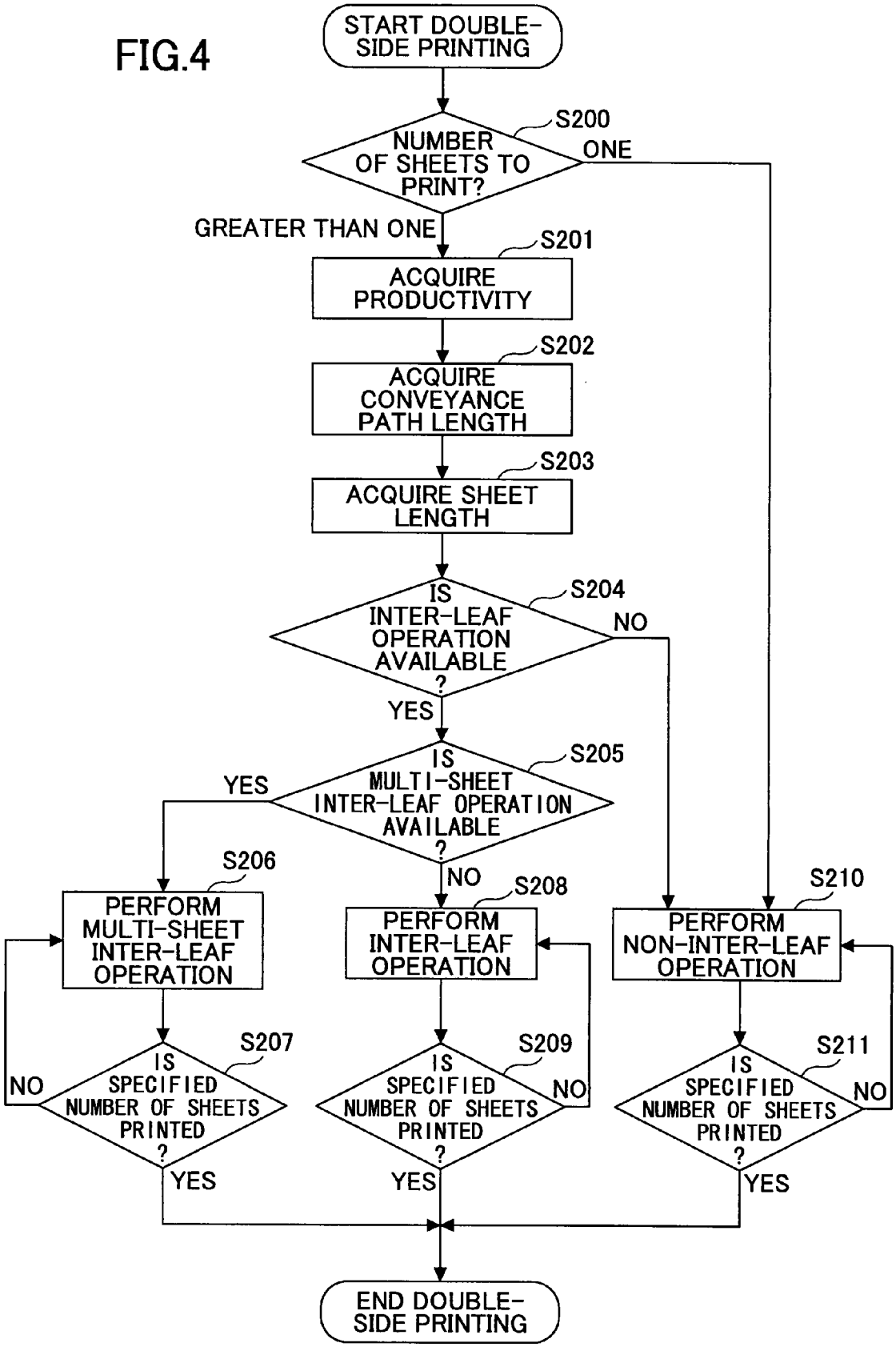
FIG. 4 is a flowchart of the double-side printing control process in the case where a conveyance path length is greater than the sheet length.

FIG. 4 is a flowchart showing the double-side printing control process wherein the conveyance path length is great compared with the sheet length. At step S200, the number of sheets to be printed is specified. If only one sheet is to be printed, double-side printing is performed by the non-inter-leaf operation at step S210. If more than one sheet is to be printed, the parameters (productivity, conveyance path length, and sheet length) that determine the availability of the inter-leaf operation (whether the inter-leaf operation can be performed) are acquired at steps S201, S201, and S203. Then, the availability of the inter-leaf operation is determined at step S204. If affirmative, whether multi-sheet inter-leaf operation is possible is determined at step S205. According to the determination, one of the multi-sheet inter-leaf operation (step S206), the inter-leaf operation (step S208), and the non-inter-leaf operation (step S210) is repeated until the specified number of sheets are processed (steps S207, S209, and S211). Here, the "multi-sheet" refers to three or more sheets as described above. Further, the inter-leaf operation is desirable to perform operations on the greatest number of sheets that can be handled by the inter-leaf operation with reference to the conveyance path length.

Figure 5:
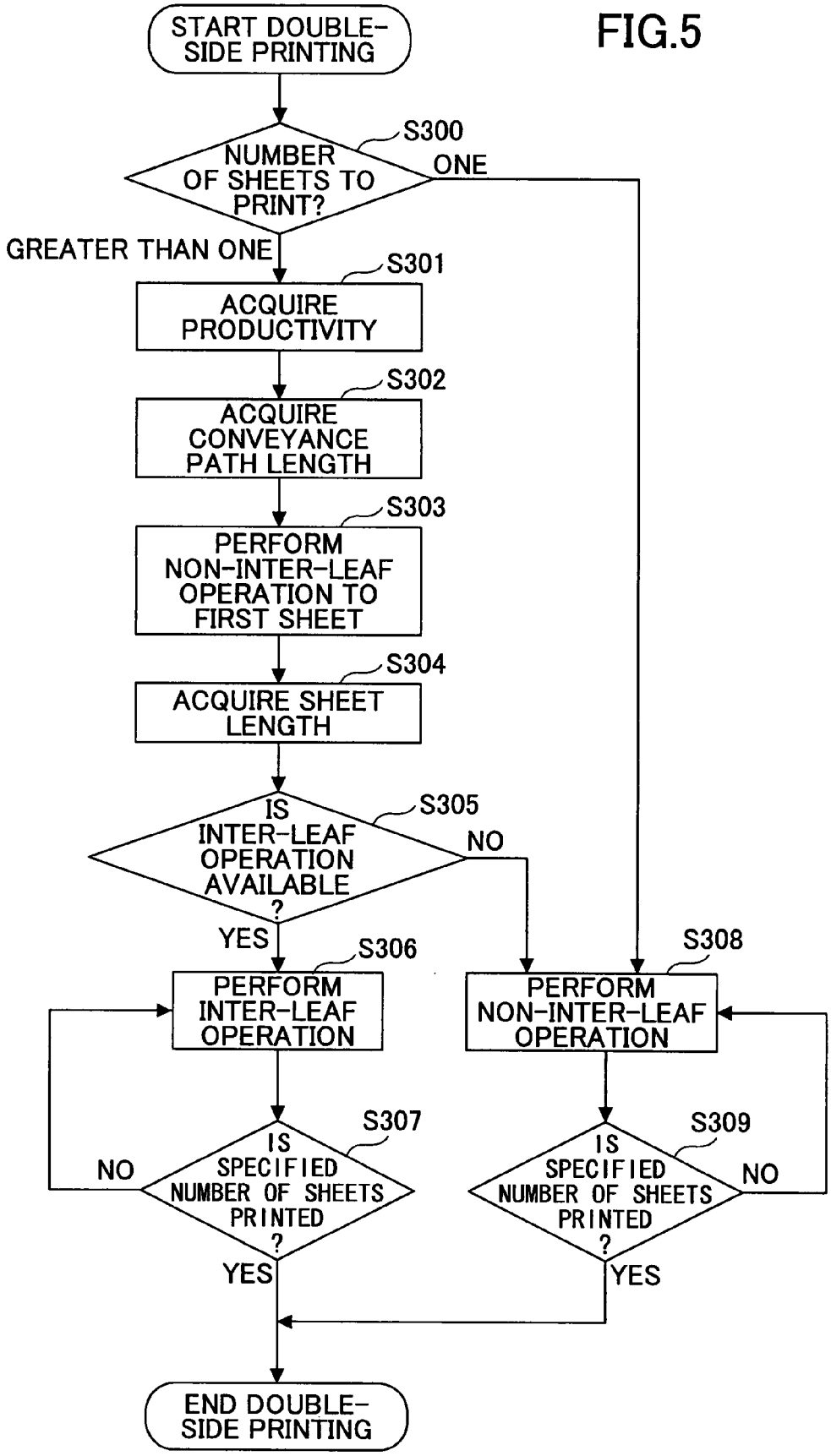
FIG. 5 is a flowchart of the double-side printing control process in the case where the sheet length is fixed but unknown at the time of feeding the sheet.

FIG. 5 is a flowchart of the double-side printing control process wherein the sheet size is fixed and the sheet length is unknown at the time of feed start. First, whether the number of sheets to be printed is one or greater than one is determined at step S300. If only one sheet is to be printed, double-side printing is performed by the non-inter-leaf operation at step S308. If more than one sheet is to be printed, the parameters (productivity and conveyance path length) that determine the availability of the inter-leaf operation are acquired at steps S301 and S302. Then, the first sheet is printed by the non-inter-leaf operation at step S303; and during printing, the sheet length is acquired at step S304. Depending on the acquired sheet length and the parameters, whether the inter-leaf operation is possible is determined at step S305. If affirmative, the inter-leaf operation is performed until the specified number of sheets is processed at S306 and S307. If negative, the non-inter-leaf operation is performed until the specified number of sheets is processed at step 308 and S309.

Here, the sheet length is determined by measuring the time interval during which the sheet passes through one of the resist sensor 105, the delivery sensor 106, and the double-side sensor 107, and by multiplying the time interval by the linear velocity at the location of the applicable sensor.

As described above, according to the embodiment, the following effects obtained.

1) The availability of the inter-leaf operation (whether the inter-leaf operation can be used) is determined by the sheet length, the conveyance path length, and the productivity (space/interval between sheets). Then, if the inter-leaf and the non-inter-leaf operations are appropriately switched (selected) according to the parameters, efficiency can be maintained. Accordingly, in the embodiment, the inter-leaf and non-inter-leaf operations are switched depending on the sheet length. In this way, the reduction of productivity can be prevented.

2) Out of the parameters that determine the availability of the inter-leaf operation, the conveyance path length and the productivity are fixed factors that are given by the layout and specifications of the image formation apparatus. On the other hand, the sheet length depends on the sheet specified by a user, and therefore, is unfixed. For this reason, it is necessary to acquire the sheet length of the sheet that is to be fed. According to the embodiment, the sheet length is acquired by one of the following method:

the sheet length detection sensor measures the sheet length;

the automatic manuscript feeding unit measures the sheet length;

the sheet length is input to the controller; and the resist sensor measures the sheet length.

Then, whether the inter-leaf or the non-inter-leaf operation is to be carried out is determined based on the acquired sheet length. In this way, the fall of productivity is prevented.

3) In the case of double-side printing wherein sheet lengths are intermingled, sheets that can be processed by the inter-leaf operation may not be consecutively provided, but a sheet that can be processed by the inter-leaf operation and another sheet that cannot be processed by the inter-leaf operation may be alternately provided. According to the embodiment, the inter-leaf operation is carried out only when two or more sheets that can be processed by the inter-leaf operation are provided, referring to sheet lengths of the previous sheet and the following sheet. In this way, the loss of productivity associated with performing the inter-leaf operation is prevented.

4) Conventionally, the inter-leaf operation tends to degrade the productivity if the conveyance path length is greater than the sheet length, and an improvement is desired. According to the embodiment, the inter-leaf operation is carried out if there are three or more sheets in the conveyance path, and the loss of productivity is prevented.

5) In the case where the sheet length is acquired by the resist sensor, the determination whether the inter-leaf operation is possible tends to be late. For this reason, depending on the distance from the sheet feeding unit to the resist sensor and/or a targeted productivity level, the inter-leaf operation from the first sheet may not be available. In this case, it is desired to decrease the number of sheets of double-side printing by the non-inter-leaf operation as much as possible. According to the embodiment, only the first sheet is processed by the non-inter-leaf operation, then the sheet length is acquired, and the inter-leaf operation is carried out with the second sheet and onward if possible. In this way, the loss of productivity is prevented.

Further, the present invention is not limited to these embodiments, but variations and modifications may be made without departing from the scope of the present invention.

The present application is based on Japanese Priority Application No. 2006-056748 filed on Mar. 2, 2006 with the Japanese Patent Office, the entire contents of which are hereby incorporated by reference.

What is claimed is:

1. An image formation apparatus, comprising:

a feed roller for feeding a sheet;

an image formation unit for forming an image on the sheet, the image formation unit including a secondary transfer roller for transferring a toner image onto the sheet;

a fixing unit for fixing the image formed on the sheet;

a sheet reversing unit for reversing the sheet;

a double-side conveyance path through which the reversed sheet passes; and a control unit for controlling switching between an inter-leaf operation and a non-inter-leaf operation, the switching between the inter-leaf operation and the non-inter-leaf operation being determined by the control unit based on a sheet length, wherein the inter-leaf operation includes a first printing process of continuously forming an image on one side of a plurality of sheets fed by the feed roller until a processed sheet, amongst the plurality of sheets bearing the image on the one side, reaches the secondary transfer roller after having been reversed by the sheet reversing unit, and a second printing process of alternately forming an image on the other side of the processed sheet and on a side of another sheet fed by the feed roller, said another sheet not yet bearing an image, after the processed sheet of the plurality of sheets reaches the secondary transfer roller, and the non-inter-leaf operation includes continuous printing processes of forming an image on one side of a sheet fed by the feed roller, and forming an image on the other side of the sheet reversed by the reversing unit, a next image formed by the image formation unit after the image formed on the one side of the sheet being the image formed on the other side of the same sheet.

2. The image formation apparatus as claimed in claim 1, further comprising:

a sheet loading unit for loading the sheet; and a sheet size detection sensor for detecting the sheet length provided to the sheet loading unit.

3. The image formation apparatus as claimed in claim 1, further comprising:

an automatic manuscript reading unit for acquiring an image size to be formed on the sheet; wherein a sheet of a size that suits the image size is fed, and switching between the inter-leaf and the non-inter-leaf operations is carried out based on the sheet length.

4. The image formation apparatus as claimed in claim 1, further comprising:

a controller for inputting an image size to be formed on the sheet; wherein a sheet of a size that suits the image size is fed, and switching between the inter-leaf and the non-inter-leaf operations is carried out based on the sheet length.

5. The image formation apparatus as claimed in claim 1, further comprising:

a resist sensor for detecting the sheet being transported for measuring the sheet length.

6. The image formation apparatus as claimed in claim 5, wherein the sheet length is acquired by performing the non-inter-leaf operation for double-side printing only for a first sheet, and the inter-leaf operation is carried out if the acquired sheet length allows the inter-leaf operation.

7. The image formation apparatus as claimed in claim 1, wherein the control unit carries out the inter-leaf operation if the inter-leaf operation is determined to be available based on the sheet length of two or more consecutive sheets.

8. The image formation apparatus as claimed in claim 1, wherein the control unit carries out the inter-leaf operation for a greatest possible number of sheets if the inter-leaf operation for three or more sheets is determined to be available with reference to the acquired sheet length.

9. The image formation apparatus as claimed in claim 7, wherein the control unit carries out the inter-leaf operation for the two or more consecutive sheets.

10. The image formation apparatus as claimed in claim 1, wherein the control unit carries out the non-inter-leaf operation if specified number of sheets to be printed is one, and determines availability of the inter-leaf operation if the specified number of sheets to be printed is more than one.

11. An image formation apparatus, comprising:

a feed roller for feeding a sheet;

an image formation unit for forming an image on the sheet, the image formation unit including a secondary transfer roller for transferring a toner image onto the sheet;

a fixing unit for fixing the image formed on the sheet;

a sheet reversing unit for reversing the sheet;

a double-side conveyance path through which the reversed sheet passes; and a control unit for controlling switching between an inter-leaf operation and a non-inter-leaf operation, the switching between the inter-leaf operation and the non-inter-leaf operation being determined by the control unit based on a sheet length, wherein the inter-leaf operation includes a first printing process of continuously forming an image on one side of a plurality of sheets fed by the feed roller until a processed sheet, amongst the plurality of sheets bearing the image on the one side, reaches the secondary transfer roller after having been reversed by the sheet reversing unit, and a second printing process of alternately forming an image on the other side of the processed sheet and on a side of another sheet fed by the feed roller, said another sheet not vet bearing an image, after the processed sheet of the plurality of sheets reaches the secondary transfer roller, and the second printing process is commenced on said another sheet before the image is formed by the second printing process on the other side of the processed sheet and after the one side of the processed sheet has been printed, and the non-inter-leaf operation includes continuous printing processes of forming an image on one side of a sheet fed by the feed roller, and forming an image on the other side of the sheet reversed by the reversing unit, a next image formed by the image formation unit after the image formed on the one side of the sheet being the image formed on the other side of the same sheet.

12. The image formation apparatus as claimed in claim 1, wherein the control unit determines based at least in part on the sheet length whether the inter-leaf operation available for the plurality of sheets, and if the control unit determines based at least in part on the sheet length that the inter-leaf operation is not available for the plurality of sheets, the control unit causes the non-inter-leaf operation to be performed for the plurality of sheets.

* * * * *